US009229362B1

(12) United States Patent
Takahashi

(10) Patent No.: US 9,229,362 B1
(45) Date of Patent: Jan. 5, 2016

(54) IMAGE FORMING APPARATUS FOR CONTROLLING THE DENSITY OF MULTIPLE TONERS AND IMAGE FORMING METHOD FOR THE SAME

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Koji Takahashi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/521,522

(22) Filed: Oct. 23, 2014

(51) Int. Cl.
*G03G 15/08* (2006.01)

(52) U.S. Cl.
CPC ..... *G03G 15/0831* (2013.01); *G03G 15/08* (2013.01)

(58) Field of Classification Search
CPC ... G03G 15/06; G03G 15/08; G03G 15/5058; G03G 2215/0164; B41J 2/2114
USPC ..... 399/1, 2, 39, 53, 55, 222, 223, 49
See application file for complete search history.

(56) References Cited

U.S. PATENT DOCUMENTS

| | | | | |
|---|---|---|---|---|
| 8,718,525 | B2 | 5/2014 | Kikuchi | |
| 2006/0017767 | A1* | 1/2006 | Matsuzawa et al. | 347/21 |
| 2007/0019245 | A1* | 1/2007 | Katsurabayashi | 358/3.28 |
| 2012/0027433 | A1* | 2/2012 | Brown et al. | 399/27 |
| 2012/0213537 | A1* | 8/2012 | Harashima | 399/49 |

* cited by examiner

*Primary Examiner* — Sophia S Chen
(74) *Attorney, Agent, or Firm* — Amin, Turocy & Watson, LLP

(57) ABSTRACT

In accordance with one embodiment, an image forming apparatus has a first image forming section, a second image forming section and an image forming agent adhesion amount control section. The first image forming section forms an image with decolorable image forming agent. The second image forming section forms an image with non-decolorable image forming agent. The image forming agent adhesion amount control section carries out a control to make the amount of the non-decolorable image forming agent adhered to a sheet smaller than that of the decolorable image forming agent adhered to the sheet.

13 Claims, 5 Drawing Sheets

IMAGE FORMING APPARATUS FOR CONTROLLING THE DENSITY OF MULTIPLE TONERS AND IMAGE FORMING METHOD FOR THE SAME

FIELD

Embodiments described herein relate generally to an image forming apparatus and an image forming method.

BACKGROUND

In recent years, for the sake of the environment, there has been proposed an image forming apparatus which forms an image on a sheet-like medium (hereinafter referred to as a "sheet") such as paper and the like with decolorable image forming agent so that the printed paper can be reused. The toner material used as the decolorable image forming agent has a function of being decolored through, for example, external stimuli such as temperature, light having a specific wavelength, pressure and the like. The image formed with the decolorable toner is decolored by a given decoloring device. Thus, a user can reuse the sheet repeatedly.

However, there is a case in which the difference in image density between the image formed with the decolorable toner and the image formed with the non-decolorable toner is noticeable.

DETAILED DESCRIPTION

In accordance with one embodiment, an image forming apparatus comprises a first image forming section, a second image forming section and an image forming agent adhesion amount control section. The first image forming section forms an image with decolorable image forming agent. The second image forming section forms an image with non-decolorable image forming agent. The image forming agent adhesion amount control section carries out a control to make the amount of the non-decolorable image forming agent adhered to a sheet smaller than that of the decolorable image forming agent adhered to the sheet.

Hereinafter, the image forming apparatus according to the embodiment is described with reference to the accompanying drawings.

Figure 1:
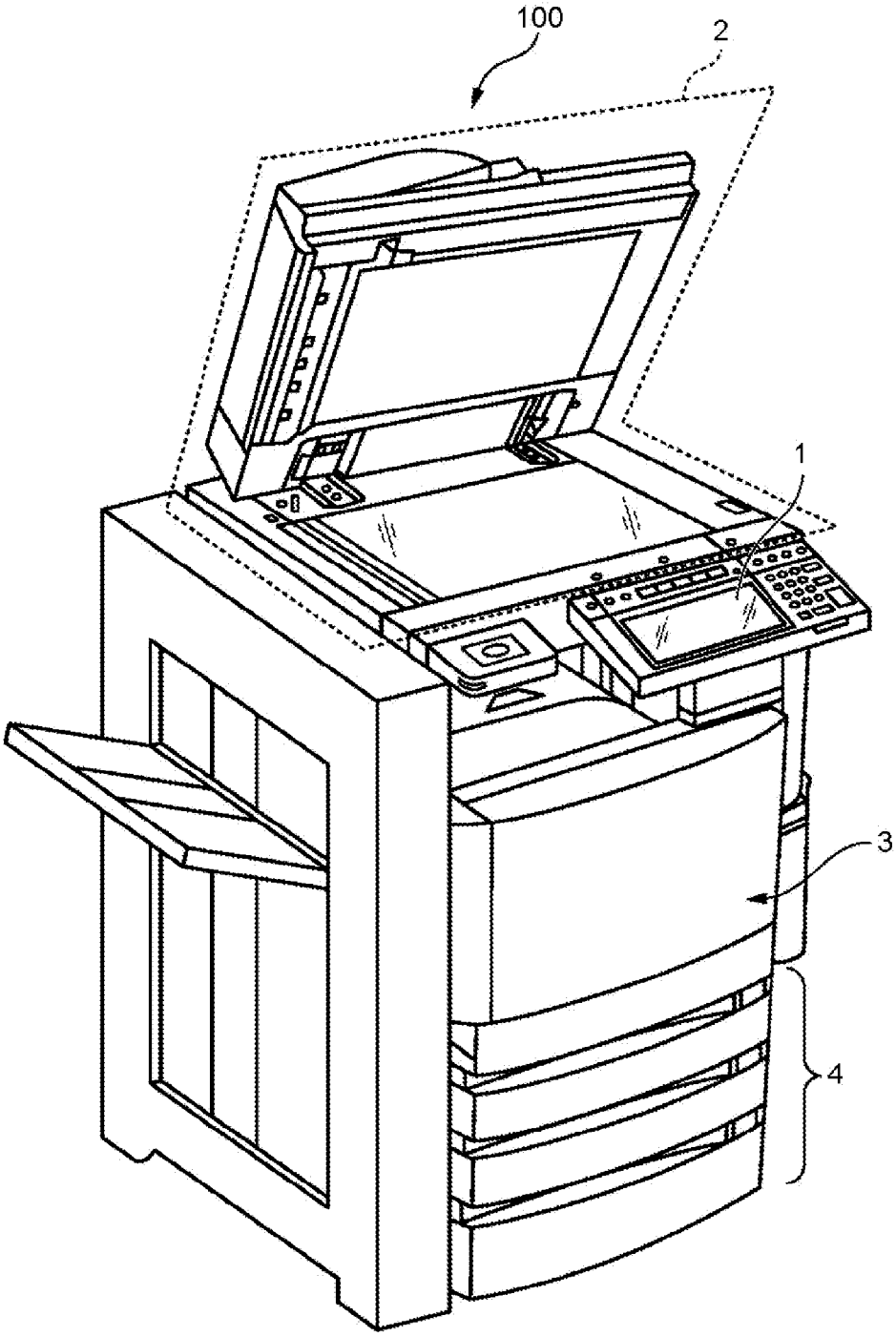
FIG. 1 is an external view illustrating an example of the constitution of an image forming apparatus 100 according to one embodiment.

FIG. 1 is an external view illustrating one example of an image forming apparatus 100 according to the embodiment. For example, the image forming apparatus 100 is a multi function peripheral (MFP). The image forming apparatus 100 reads an image formed on a sheet to generate digital data (image file). The image forming apparatus 100 forms an image on the sheet with either of decolorable image forming agent or non-decolorable image forming agent based on the digital data. The "decoloring" in the present embodiment refers to making the image, which is formed in a color (including not only chromatic color but also achromatic color such as white color, black color and the like) different from the ground color of the paper, invisible.

The image forming apparatus 100 includes a display section 1, an image reading section 2, a printing section 3 and a tray 4. The image forming apparatus 100 is not limited to an image forming apparatus which fixes a toner image. The image forming apparatus 100 may be an inkjet type image forming apparatus.

The display section 1 is, for example, a liquid crystal display provided with a touch panel. The display section 1 operates as an output interface to display characters and images. The display section 1 also operates as an input interface to receive an input of an instruction from a user.

The image reading section 2 is, for example, a color scanner provided with a contact image sensor (CIS), a charge coupled devices (CCD) and the like. The image reading section 2 reads, with a sensor, the image formed on the sheet to generate digital data.

The printing section 3 forms an image on the sheet with either of the decolorable image forming agent or the non-decolorable image forming agent.

Figure 2:
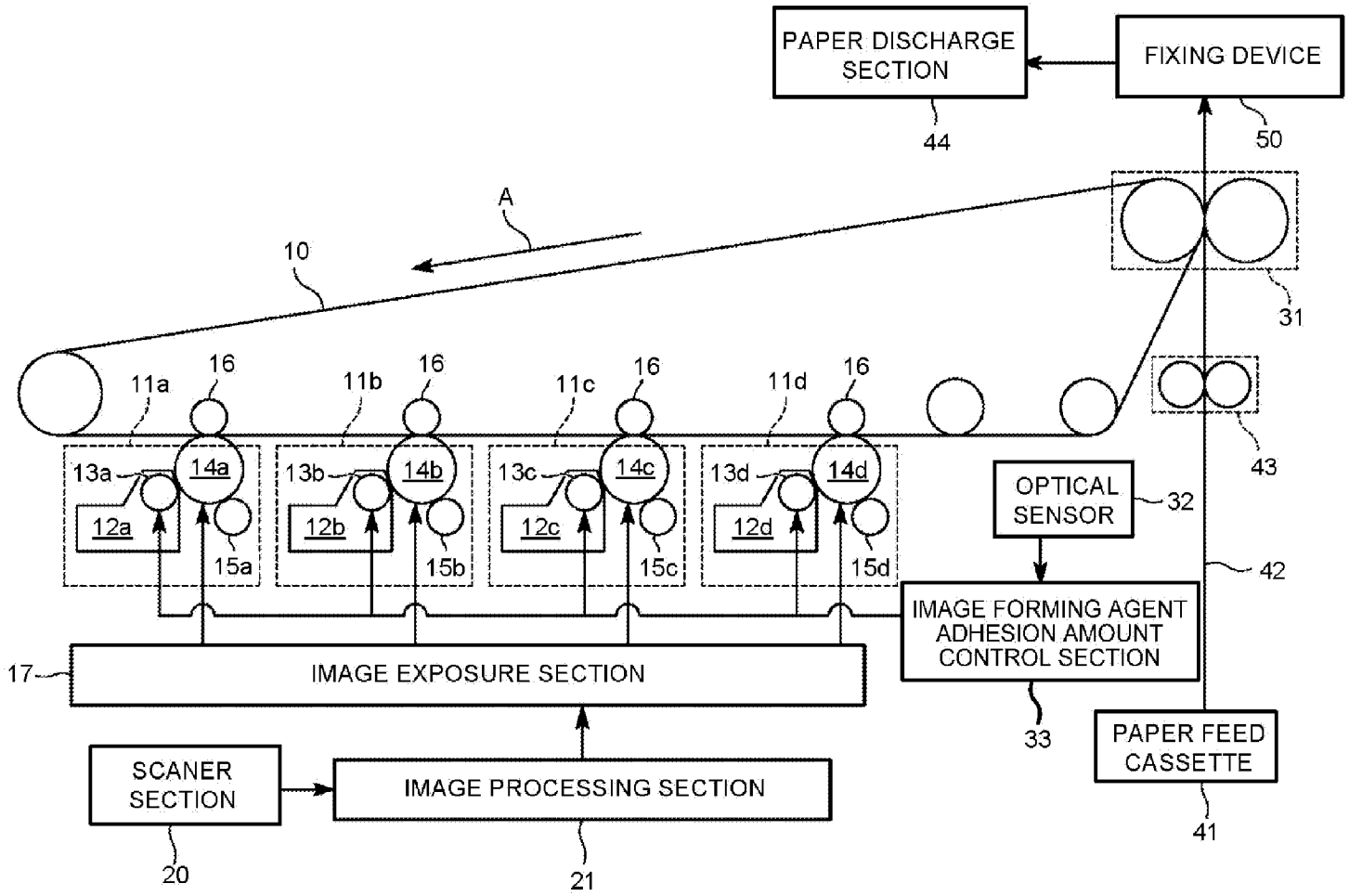
FIG. 2 is a diagram illustrating an example of the schematic constitution of the image forming apparatus 100 according to the embodiment.

FIG. 2 is a diagram illustrating an example of the schematic constitution of the image forming apparatus 100 according to the embodiment. The image forming apparatus 100 shown in FIG. 2 is an electrophotographic type color image forming apparatus. The image forming apparatus 100 shown in FIG. 2 is a tandem image forming apparatus. There is a first transfer process and a second transfer process in the image forming apparatus 100. In the first transfer process, each image forming section 11*a*-11*d* multiple-transfers the image formed with toner to an intermediate transfer body 10 in an overlapped manner. In the second transfer process, the toner images on the intermediate transfer body 10 are collectively transferred to the sheet. Different kinds of toner are used in each image forming section 11*a*-11*d*, in this way, an image formed with a plurality of kinds of toner can be printed on one sheet. For example, an image formed with decolorable toner and an image formed with normal toner can be printed on one sheet by using the decolorable toner and the normal toner in each image forming section 11*a*-11*d*. The decolorable toner is the decolorable image forming agent. The normal toner is the non-decolorable image forming agent.

In FIG. 2, the image forming apparatus 100 includes the intermediate transfer body 10, the plurality of image forming sections 11*a*-11*d*, a primary transfer roller 16, an image exposure section 17, a scanner 20, an image processing section 21, a secondary transfer position 31, an optical sensor 32, an image forming agent adhesion amount control section 33, a paper feed cassette 41, a paper conveyance path 42, a register roller 43, a paper discharge section 44 and a fixing device 50.

The intermediate transfer body 10, which is an endless belt, rotates in a direction indicated by an arrow A show in FIG. 2.

Each of the image forming sections 11*a*-11*d* forms an image with toner of a single color. The image forming sections 11*a*-11*d* are arranged in sequence along the intermediate transfer body 10 from the upstream side of the rotation direction of the intermediate transfer body 10.

The first image forming section 11*a* includes a developing device 12*a*, a photoconductive drum 14*a* and a charger 15*a*.

The developing device 12*a* adheres toner to the photoconductive drum 14*a*. The developing device 12*a* stores developer. The developer includes toner serving as the image forming agent and ferrite carrier. The developing device 12*a* is provided with a developing roller (magnet roller) 13*a* to which high voltage (developing bias) is applied. The developing bias is applied for transferring toner from the developing device 12*a* to the photoconductive drum 14*a*. The amount of the toner to be transferred to the photoconductive drum 14*a* is adjusted by adjusting the magnitude of the developing bias. For example, in a case in which a developing bias of negative polarity is applied to the developing roller 13*a*, if the negative polarity of the developing bias is lowered, the amount of the toner to be transferred to the photoconductive drum 14*a* is reduced. "Lowering the negative polarity of the developing bias" refers to decreasing the absolute value of the voltage while maintaining the polarity of the developing bias to be negative.

The photoconductive drum 14*a* serving as an image carrier (image carrying unit) has a photoconductor (photosensitive area) on the outer peripheral surface thereof.

The charger 15*a* uniformly charges the surface of the photoconductive drum 14*a*.

The second image forming section 11*b*, the third image forming section 11*c* and the fourth image forming section 11*d* are structurally identical to the first image forming section 11*a*, thus, the description thereof is omitted.

Each primary transfer roller 16 is arranged opposite to each of the photoconductive drums 14*a*-14*d* of the image forming sections 11*a*-11*d* across the intermediate transfer body 10.

The image exposure section 17 provided with an exposure light source irradiates (exposes) each of the photoconductive drums 14*a*-14*d* of the image forming sections 11*a*-11*d* with light. The image exposure section 17 irradiates the photoconductive drums 14*a*-14*d* used to form an image of a corresponding color with the image light (color signal of each color) corresponding to each color of the image to be formed. The image exposure section 17 is controlled by the image processing section 21.

Hereinafter, the schematic operations of the image forming apparatus 100 are described by exemplifying a case of copying.

The scanner 20 reads the image formed on the sheet and outputs the read image to the image processing section 21 as image data.

The image processing section 21 converts the image data into a color signal of each color. The image processing section 21 controls the image exposure section 17 based on the color signal of each color.

Next, the operation of the first image forming section 11*a* is described.

The photoconductive drum 14*a* is charged by the charger 15*a* to a given potential. Then, the light from the image exposure section 17 is radiated to the photoconductive drum 14*a*. In this way, the potential of the area on the photoconductive drum 14*a* where the light is radiated is changed. Thus, an electrostatic latent image is formed on the surface of the photoconductive drum 14*a*. The electrostatic latent image on the surface of the photoconductive drum 14*a* is developed with the developer of the developing device 12*a*. For example, the photoconductive drum 14*a* is uniformly charged to negative potential by the charger 15*a*. Then if the light is radiated by the image exposure section 17, the surface potential of the area on the photoconductive drum 14*a* where the light is radiated is close to 0V. In the developer, the toner is negatively charged while the ferrite carrier is positively charged. Thus, the toner is attracted and adhered to the area on the surface of the photoconductive drum 14*a* where the light is radiated. That is, an image (hereinafter referred to as a "first toner image") is formed on the surface of the photoconductive drum 14*a* with toner.

The operations of the second image forming section 11*b*, the third image forming section 11*c* and the fourth image forming section 11*d* are the same as the operation of the first image forming section 11*a* except that the color of the developer (toner) stored therein is different, thus, the description thereof is omitted. In the following description, the image formed with toner on the surface of the photoconductive drum 14*b* is referred to as a "second toner image", the image formed with toner on the surface of the photoconductive drum 14*c* is referred to as a "third toner image", and the image formed with toner on the surface of the photoconductive drum 14*d* is referred to as a "fourth toner image".

Next, the first transfer process is described. The first toner image is transferred to the intermediate transfer body 10 by the primary transfer roller 16 arranged opposite to the photoconductive drum 14*a*. Then the second toner image is transferred to the intermediate transfer body 10 by the primary transfer roller 16 arranged opposite to the photoconductive drum 14*b*. The second toner image is transferred to be overlapped with the first toner image. Then the third toner image is transferred to the intermediate transfer body 10 by the primary transfer roller 16. The third toner image is transferred to be overlapped with the first and the second toner images. Then the fourth toner image is transferred to the intermediate transfer body 10 by the primary transfer roller 16. The fourth toner image is transferred to be overlapped with the first-third toner images. In this way, the first-fourth toner images are overlapped on the intermediate transfer body 10.

Next, the control on the amount of the toner adhered to the intermediate transfer body 10 is described. The image forming apparatus 100 carries out a control to maintain the image quality at given timing. Specific examples of the given timing are as follows: the timing when the power source of the image forming apparatus 100 is turned on, or the timing when the image forming apparatus 100 carries out a given number of printings. The given number is, for example, the multiple of 500. The image forming apparatus 100 forms a preset pattern image on the intermediate transfer body 10 as the control for maintaining the image quality. The optical sensor 32 detects the amount of the toner on the pattern image formed on the intermediate transfer body 10. The optical sensor 32 may detect the image density of the pattern image to detect the amount of the toner on the pattern image. The image forming agent adhesion amount control section 33 controls the developing bias based on the amount of the toner detected by the optical sensor 32. The amount of the toner to be transferred to the photoconductive drums 14*a*-14*d* is adjusted through the control on the developing bias to be applied to the developing rollers 13*a*-13*d*. Thus, the image density of the toner images (first-fourth toner images) of each color is adjusted individually. In this way, the image forming apparatus 100 carries out feedback based on the amount of the toner detected by the optical sensor 32 to adjust the image density of the toner image of each color to a desired density.

Next, the second transfer process is described. The toner images (first-fourth toner images) of each color overlapped on the intermediate transfer body 10 are collectively transferred (secondarily transferred) to the sheet at the secondary transfer position 31. The unfixed toner image secondarily transferred to the sheet is heated and pressed by the fixing device 50 to be fixed on the sheet.

Figure 3:
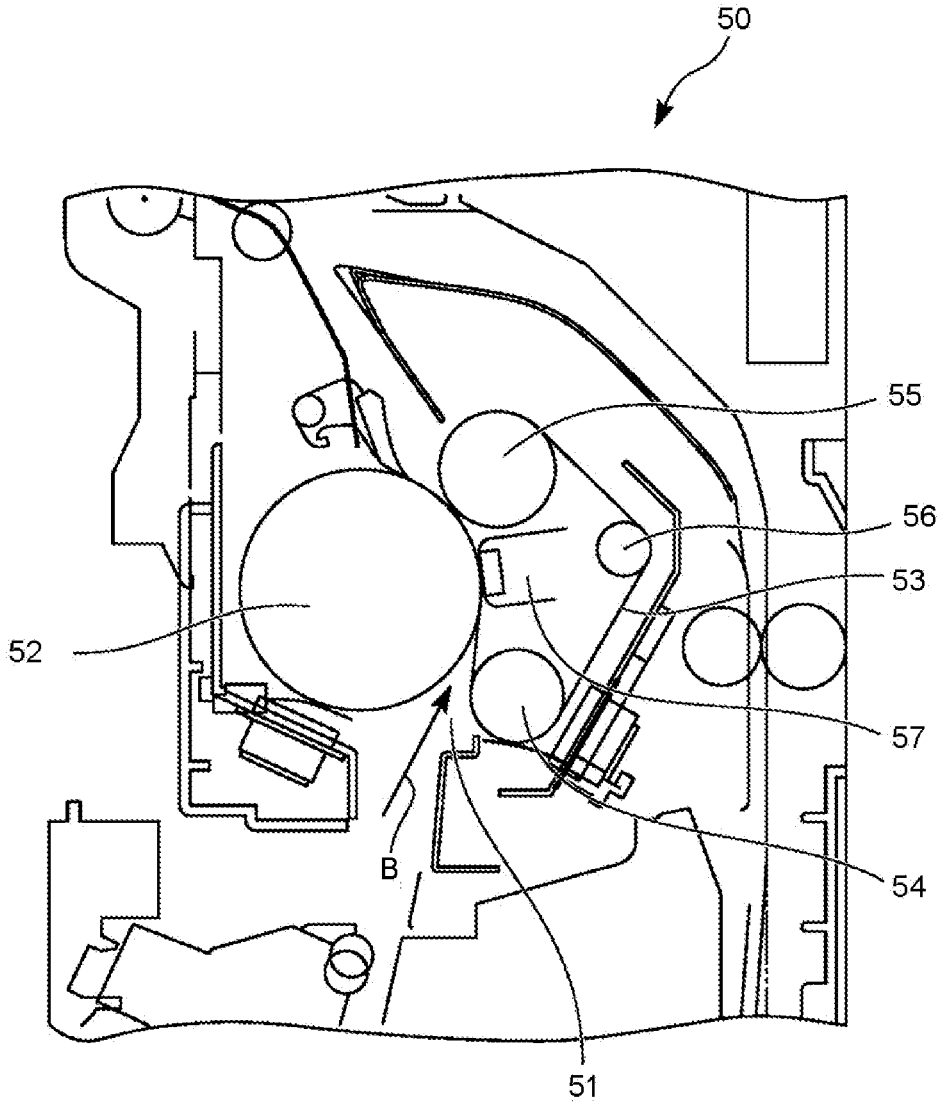
FIG. 3 is a diagram illustrating an example of the schematic constitution of a fixing device 50.

FIG. 3 is a diagram illustrating an example of the schematic constitution of the fixing device 50. FIG. 3 is a front view of the fixing device 50. The fixing device 50 includes a nip 51, a heating roller 52, a fixing belt 53, a belt heating roller 54, a pressing roller 55, a tension roller 56 and a pressure pad 57.

The nip 51 is a nip between the heating roller 52 and the fixing belt 53 through which the sheet to which the unfixed toner image (unfixed developer image) is transferred is passed in a direction indicated by an arrow B.

A heater arranged inside the heating roller 52 is energized to heat the heating roller 52 to a given temperature.

The fixing belt 53, which is an endless belt, is stretched by the belt heating roller 54, the pressing roller 55 and the tension roller 56. A heater arranged inside the belt heating roller 54 is energized to heat the belt heating roller 54. The fixing belt 53 is heated to a given temperature by the belt heating roller 54.

The pressure pad 57 presses the fixing belt 53 against the outer peripheral surface of the heating roller 52 at the position of the nip 51. The fixing belt 53 and the heating roller 52 are contacted with each other in pressure through the pressure pad 57.

The sheet and the toner image on the sheet are heated and pressed when passing through the nip 51 of the fixing device 50. In this way, the toner image is fixed on the sheet.

The sheet is conveyed on the paper conveyance path 42 from the paper feed cassette 41 to the register roller 43, the secondary transfer position 31, the fixing device 50 and the paper discharge section 44.

Figure 4:
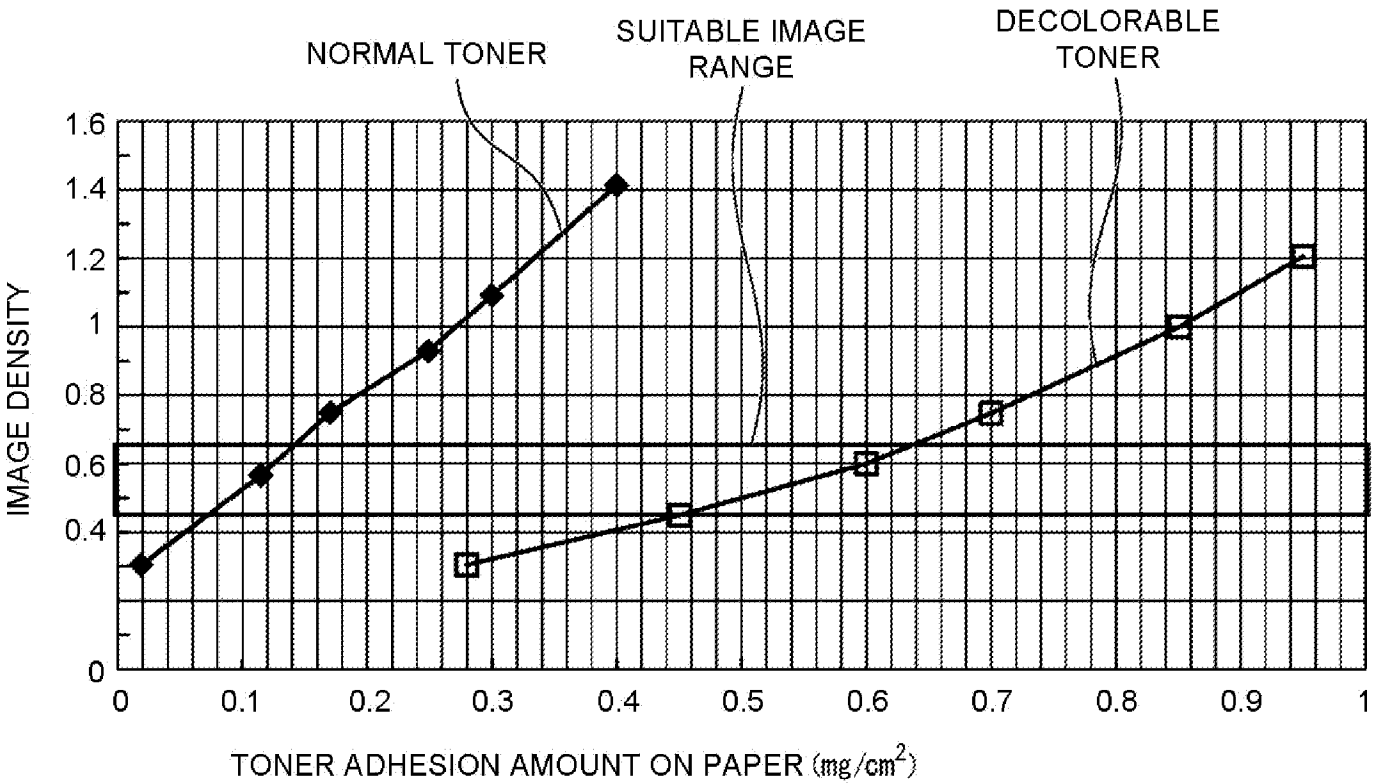
FIG. 4 is a graph illustrating the relation between the image density and the toner adhesion amount of normal toner and decolorable toner of colors belonging to a blue color system.

FIG. 4 is a graph illustrating the relation between the image density and the toner adhesion amount of cyan non-decolorable toner (normal toner) and blue decolorable toner. The ordinate in the graph in FIG. 4 indicates the image density. The abscissa in the graph in FIG. 4 indicates the toner adhesion amount on the paper. The image density is measured through a Macbeth concentration meter RD-913 (manufactured by Macbeth Corp.).

In FIG. 4, the larger the toner adhesion amount of the normal toner and the decolorable toner on the paper is, the higher the image density is. However, the normal toner and the decolorable toner are different in the tinting strength. In the specific example shown in FIG. 4, in a case in which the toner adhesion amount on the paper is 0.4 ($mg/cm^2$), the image density of the decolorable toner is 0.4, while the image density of the normal toner is 1.4, which is 3.5 times as high as the image density of the decolorable toner. Thus, in a case in which two images are formed by adhering the same amount of toner to the sheet, the image formed with the normal toner and the image formed with the decolorable toner are different in the image density. Thus, in a case in which two images are formed by adhering the same amount of toner to the sheet, the user may feel uncomfortable due to the difference in image density between the image formed with the normal toner and the image formed with the decolorable toner.

The toner adhesion amount of the normal toner and the decolorable toner on the sheet is controlled, in this way, the uncomfortable feeling (uneven concentration) caused by the difference in image density can be reduced. In the specific example shown in FIG. 4, to obtain an image density of 0.6, the toner adhesion amount of the normal toner on the paper is 0.12 ($mg/cm^2$), and toner adhesion amount of the decolorable toner on the paper is 0.6 ($mg/cm^2$). In this case, to obtain an image density of 0.6, the required adhesion amount of the normal toner is ⅕ of the adhesion amount of the decolorable toner. From the viewpoint of reducing the uncomfortable feeling of the user caused by the difference in image density, the image density of the image formed with the normal toner may be 0.8-1.5 times as high as the image density of the image formed with the decolorable toner.

The image density range suitable for the use of the decolorable toner is 0.45-0.65 in the specific example shown in FIG. 4. The lower limit (0.45) of the image density range is an image density that is needed for the user to recognize the characters having a certain size in the image. The upper limit (0.65) of the image density range is determined based on the decoloring residual after the image formed with the decolorable toner is decolored. The upper limit of the image density range is a condition used to prevent that the decoloring residual overlaps and is recognized as an image in a case in which the formation and decoloring of the image formed with the decolorable toner is carried out repeatedly. The lower limit value of the image density suitable for the use of the non-decolorable toner is also 0.45, which is an image density that is needed for the user to recognize the characters having a certain size in the image.

In the specific example shown in FIG. 4, the cyan non-decolorable toner and the blue decolorable toner belonging to the same color system are compared. As to other color, the tinting strength of the decolorable toner is lower than that of the normal toner of a color belonging to the same color system. The colors belonging to the same color system refer to colors the tints of which are similar when viewed by naked-eyes. The colors belonging to the same color system refer to, for example, colors having similar hues. For example, the color belonging to the same color system as blue color is cyan color, and the color belonging to the same color system as red color is magenta color.

The toner used in the experiment for calculating the relation between the toner adhesion amount and the image density shown in FIG. 4 is created using the following method.

First, the decolorable toner is described. The mixture generated, as binder resin particle dispersion, by mixing 95 parts by weight of polyester based resin phase of which the weight average molecular weight Mw obtained through the polycondensation of the terephthalic acid and the bisphenol A is 6300, 5 parts by weight of rice wax serving as release agent, 1.0 parts by weight of neogen R (manufactured by First Kogyo Seiyaku Co.) serving as anionic emulsifier, and 2.1 parts by weight of neutralizing agent dimethylaminoethanol at such a rate using high pressure homogenizer is used as the binder resin contained in the toner.

The mixture generated by mixing, heating and fusing 10 parts by weight of CVL (Crystal violet lactone) of leuko dye as color generation agent, 10 parts by weight of 4-hydroxybenzoic acid benzyl as color developing agent, and 80 parts by weight of lauric acid-4-benzyl oxy phenyl ethyl as temperature control agent at such a rate may be used as the color material. Then the color material is microencapsulated through a coacervation method.

10 parts by weight of the microencapsulated color material and 90 parts by weight of particle dispersion of wax and binder resin are coagulated and fused using aluminum sulfate (Al2(SO4)3). The fused material is further washed and dried to obtain toner particle. 3.5 wt. % of hydrophobic silica (SiO2) and 0.5 wt. % of titanium oxide (TiO2) are externally added to 100 parts by weight of the obtained particle to obtanon-decolorable toner (negatively charged toner). 92 parts by weight of ferrite carrier is mixed with 8 parts by weight of the obtained negatively charged toner to obtain the developer. The decolorable toner material is created according to, for example, the method disclosed in Japanese Unexamined Patent Application Publication No. 2014-63130 (reference 1).

Next, the non-decolorable cyan toner is described. The mixture generated by mixing 8 parts by weight of C.I. Pigment Blue 15-3 as coloring agent; 100 parts by weight of polyester resin as binder resin of which the acid value is 10 KOHmg, the softening point is 120 degrees centigrade, the weight molecular weight is 45000 and the number average molecular weight is 3000; 1 part by weight of Zr metal complex as charge control agent; 2 parts by weight of rice wax as wax 1 of which the melting point is 79 degrees centigrade; and 5 parts by weight of PP wax (polypropylene wax) as wax 2 of which the melting point is 145 degrees centigrade at such a rate is used as cyan toner particle material.

The toner particle materials having the composition described above are mixed, melted and kneaded. The obtained kneaded mixture is coarsely grinded and then finely grinded and classified to obtain toner particle having a volume average particle diameter (50% diameter in volumetric distribution) of 7 μm.

2.5 parts by weight of hydrophobic silica and 0.5 parts by weight of hydrophobic titanium oxide are added to and mixed with 100 parts by weight of the obtained toner particle using Henschel mixer to obtain negatively charged toner. 92 parts by weight of ferrite carrier are mixed with 8 parts by weight of the obtained negatively charged toner to obtain negatively charged cyan developer. The non-decolorable cyan toner material is created according to, for example, the method disclosed in Japanese Unexamined Patent Application Publication No. 2007-102178 (reference 2).

The image forming apparatus 100 having such a constitution includes a plurality of image forming sections and the image forming agent adhesion amount control section. The image forming apparatus 100 forms an image on the sheet with each image forming section. The image forming apparatus 100 controls the toner adhesion amount on the image formed by each image forming section on the sheet with the image forming agent adhesion amount control section. In this way, the difference in image density between the image formed with the decolorable toner and the image formed with the normal toner can be reduced, compared with the conventional apparatus.

Next, a modification of the image forming apparatus 100 is described.

Figure 5:
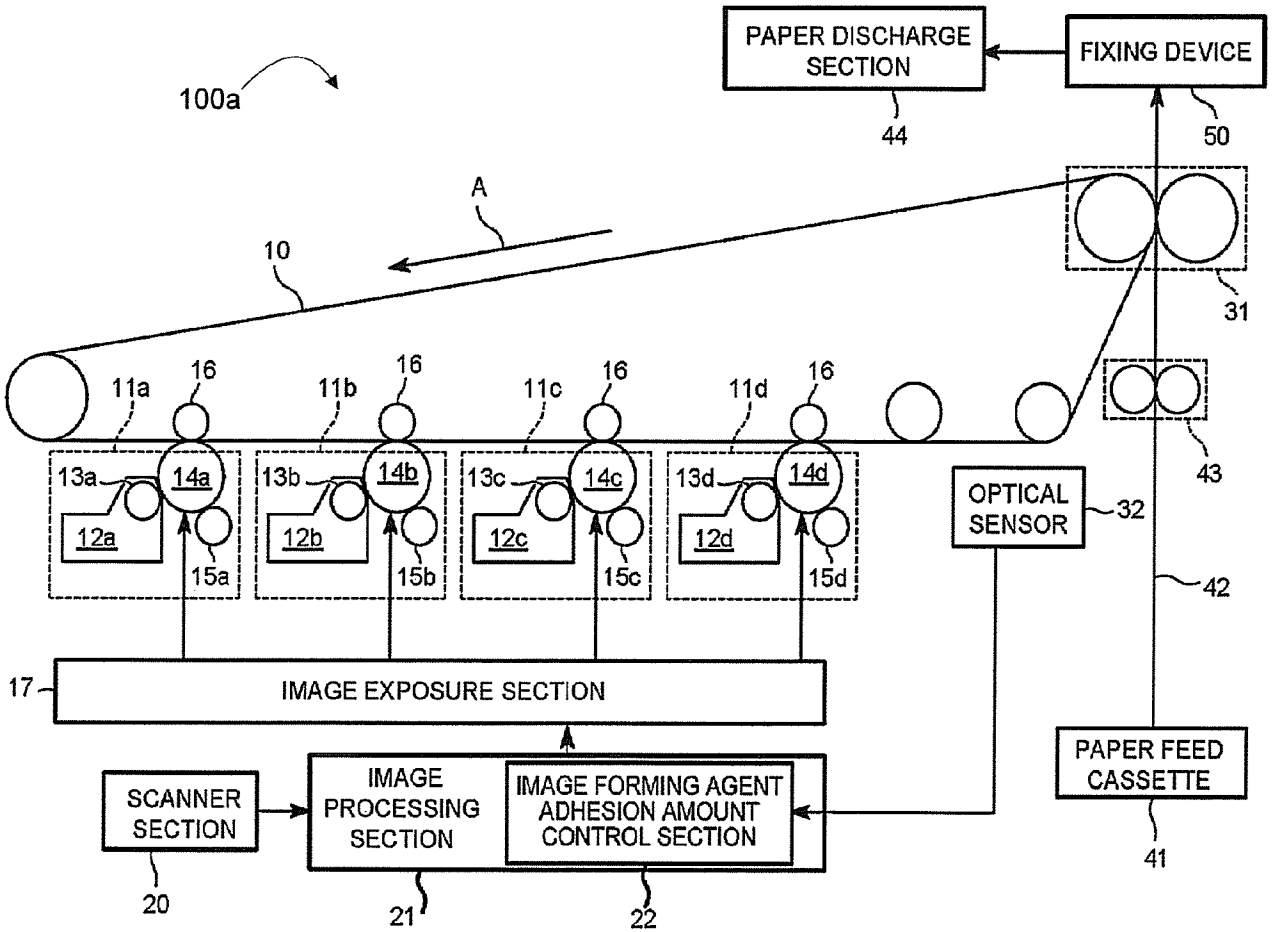
FIG. 5 is a diagram illustrating an example of the schematic constitution of an image forming apparatus 100*a* according to a modification.

The amount of the toner adhered to the intermediate transfer body 10 may be controlled by an image forming agent adhesion amount control section 22 arranged in the image processing section 21. FIG. 5 is a diagram illustrating an example of the schematic constitution of an image forming apparatus 100*a* according to the modification. In the specific example shown in FIG. 5, the image forming agent adhesion amount control section 22 is arranged in the image processing section 21.

The image forming apparatus 100 forms a preset pattern image on the intermediate transfer body 10 as the control for maintaining the image quality. The optical sensor 32 detects the amount of the toner on the pattern image formed on the intermediate transfer body 10. The optical sensor 32 may detect the image density of the pattern image to detect the amount of the toner on the pattern image. The image forming agent adhesion amount control section 22 controls the intensity of the exposure light from the image exposure section 17 based on the amount of the toner detected by the optical sensor 32. The image density of the toner images of each color is adjusted through the intensity of the image exposure light. Thus, the image density of the toner images (first-fourth toner images) of each color is adjusted individually.

The first image forming section for forming an image with the decolorable image forming agent is not necessarily to be arranged in the first image forming section 11*a* of the image forming apparatus 100, and it may also be arranged in other image forming section. The second image forming section for forming an image with the non-decolorable image forming agent is not necessarily to be arranged in the second image forming section 11*b* of the image forming apparatus 100, and it may also be arranged in other image forming section.

An electrophotographic type image forming apparatus is exemplified in the embodiment described above, however, an inkjet printer, a thermal printer and the like may also be used, and the present invention is not intended to limit the category of printers. Further, the toner in the electronic photographic printing is exemplified as the image forming agent. However, not limited to the toner, the image forming agent used in printing may also be other image forming agent such as ink and the like, and the present invention is not intended to limit the category of image forming agent.

In accordance with at least one embodiment described above, the apparatus has a function of controlling the adhesion amount of the image forming agent on the image formed on the sheet. With such a function, the apparatus is capable of controlling the adhesion amount of each kind of image forming agent according to the image forming agent to be used to form an image. Thus, compared with the conventional apparatus, the apparatus according to the present invention is capable of reducing the difference in image density caused by the difference in image forming agent to be used to form an image. That is, compared with the conventional apparatus, the apparatus according to the present invention is capable of forming an image with higher visibility on the sheet.

While certain embodiments have been described, these embodiments have been presented by way of example only, and are not intended to limit the scope of the invention. Indeed, the novel embodiments described herein may be embodied in a variety of other forms; furthermore, various' omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus comprising:

a first image forming section configured to form an image with decolorable image forming agent;

a second image forming section configured to form an image with non-decolorable image forming agent; and an image forming agent adhesion amount control section configured to control an amount of the non-decolorable image forming agent adhered to an image receiving medium to be smaller than an amount of the decolorable image forming agent adhered to the image receiving medium so that an image density of the image formed by the second image forming section on the image receiving medium is 0.8-1.5 times as high as an image density of the image formed by the first image forming section on the image receiving medium.

2. The image forming apparatus according to claim 1, wherein the image forming agent adhesion amount control section applies voltage to a developing roller of the second image forming section different from the voltage applied to a developing roller of the first image forming section.

3. The image forming apparatus according to claim 2, wherein the image forming agent adhesion amount control section controls the absolute value of the voltage applied to the developing roller of the second image forming section to be smaller than the absolute value of the voltage applied to the developing roller of the first image forming section.

4. The image forming apparatus according to claim 1, wherein an image density of the image formed by the second image forming section on the image receiving medium is substantially the same as that of the image formed by the first image forming section on the image receiving medium.

5. The image forming apparatus according to claim 1, wherein a range of the image density of the images formed by the first image forming section and the second image forming section on the image receiving medium is 0.45-0.65.

6. The image forming apparatus according to claim 1, wherein a range of the amount of the decolorable image forming agent adhered to the image receiving medium in the image formed by the first image forming section is 0.45-0.65 ($mg/cm^2$).

7. The image forming apparatus according to claim 6, wherein a range of the amount of the non-decolorable image forming agent adhered to the image receiving medium in the image formed by the second image forming section is 0.08-0.14 ($mg/cm^2$).

8. The image forming apparatus according to claim 1, wherein the color of the image formed by the first image forming section belongs to the same color system as the color of the image formed by the second image forming section.

9. The image forming apparatus according to claim 1, wherein the first image forming section and the second image forming section form images on the same image receiving medium.

10. An image forming apparatus comprising:

a first image forming section configured to form an image with a first image forming agent;

a second image forming section configured to form an image with a second image forming agent; and an image forming agent adhesion amount control section configured to control an amount of the second image forming agent adhered to an image receiving medium to be smaller than an amount of the first image forming agent adhered to the image receiving medium so that an image density of the image formed by the second image forming section on the image receiving medium is 0.8-1.5 times as high as an image density of the image formed by the first image forming section on the image receiving medium, wherein the image density of the image formed by the second image forming agent is higher than the image density of the image formed by the first image forming agent when the adhesion amount of the first image forming agent and the adhesion amount of the second image forming agent are the same.

11. The image forming apparatus according to claim 10, wherein the first image forming agent is decolorable and the second image forming agent is non-decolorable.

12. An image forming method comprising:

forming an image with a first image forming agent;

forming an image with a second image forming agent; and controlling an amount of the second image forming agent adhered to an image receiving medium to be smaller than an amount of the first image forming agent adhered to the image receiving medium so that an image density of the image formed with the second image forming agent is 0.8-1.5 times as high as an image density of the image formed with the first image forming agent, wherein the image density of the image formed with the second image forming agent is higher than the image density of the image formed with the first image forming agent when the adhesion amount of the first image forming agent and the adhesion amount of the second image forming agent are the same.

13. The image forming method according to claim 12, wherein the first image forming agent is decolorable and the second image forming agent is non-decolorable.

* * * * *